US006899085B2

(12) United States Patent
Kelly

(10) Patent No.: US 6,899,085 B2
(45) Date of Patent: May 31, 2005

(54) SELF-REGULATING SWITCH FOR SPLIT RAIL GASOLINE FUEL SUPPLY SYSTEM

(75) Inventor: William W. Kelly, Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 7 days.

(21) Appl. No.: 10/344,589

(22) PCT Filed: Aug. 13, 2001

(86) PCT No.: PCT/US01/25216

§ 371 (c)(1),
(2), (4) Date: Jul. 15, 2003

(87) PCT Pub. No.: WO02/14686

PCT Pub. Date: Feb. 21, 2002

(65) Prior Publication Data

US 2004/0123841 A1 Jul. 1, 2004

Related U.S. Application Data

(60) Provisional application No. 60/225,205, filed on Aug. 14, 2000.

(51) Int. Cl.[7] ..... F02M 69/46
(52) U.S. Cl. ..... 123/447; 123/514
(58) Field of Search ..... 123/446, 447, 123/456, 457, 459, 506, 510, 511, 514

(56) References Cited

U.S. PATENT DOCUMENTS 4,884,545 A * 12/1989 Mathis ..... 123/447
5,456,233 A * 10/1995 Felhofer ..... 123/447
6,135,734 A * 10/2000 Isozumi et al. ..... 417/542

FOREIGN PATENT DOCUMENTS

DE 19612413 A1 * 10/1997 ..... F02M/47/02
DE 19839579 C1 * 12/1999 ..... F02M/37/04
WO WO 0049283 A * 8/2000

* cited by examiner

*Primary Examiner*—Weilun Lo
(74) *Attorney, Agent, or Firm*—Alix, Yale & Ristas, LLP

(57) ABSTRACT

A common rail fuel injection system for a motor vehicle, comprising a distributor rail (16) fluidly connected to at least one fuel injector (18), an accumulator chamber (14) fluidly connected to the distributor rail, a high pressure fuel pump (10) that has an inlet for receiving fuel from a low pressure feed system (20, 22, 24) and an outlet chamber (12) for proving fuel at high pressure to the accumulator (14). A recirculation valve (52) is fluidly connected to the pump outlet chamber (12), the accumulator (14), and the low pressure feed system, wherein at a first position the recirculation valve fluidly aligns the outlet chamber (12) with the accumulator (14) and in a second position aligns the outlet chamber with the low pressure system for recirculation of fuel through the high pressure pump at the low pressure. A switching valve (50) is fluidly connected to the pump outlet chamber (12), the accumulator (14), and the recirculation valve (52), wherein at a first position the switching valve (50) actuates the recirculation valve (52) to the first position and at a second position the switching valve (50) actuates the recirculation valve (52) to the second position. The switching valve (50) has a set point pressure whereby when the pressure below which the recirculation valve (52) is set to first position and above which said valve (52) is set to second position.

8 Claims, 3 Drawing Sheets

SELF-REGULATING SWITCH FOR SPLIT RAIL GASOLINE FUEL SUPPLY SYSTEM

CROSS-REFERENCE TO RELATED APPLICATIONS

This is the national stage of International Application No. PCT/US01/25216, filed Aug. 13, 2001, which designated the United States, and which claims the benefit of U.S. Provisional Patent Application Ser. No. 60/225,205 filed Aug. 14, 2000.

BACKGROUND OF THE INVENTION

A number of potential advantages have led the automotive industry to look with increasing interest toward utilizing common rail high pressure direct injection for gasoline engines. Certain design constraints or difficulties seem to stand in the way of fully achieving the advantages.

The pressurization of fuel to high levels (e.g., above 100 bar) requires considerable pumping power, which generates considerable heat. Moreover, the industry is looking at even higher rail pressures, above 200 bar. This heat could be dissipated to a large extent, if all the fuel that is highly pressurized can be quickly injected into the engine cylinders. This is not possible, however, because the fuel pump flow rate is typically sized for engine cranking, which may be at 20–30 bar pressure at a high quantity flow rate, whereas typical steady state cruising conditions would only need 100 bar at a much lower quantity flow rate. Therefore, in a conventional pumping scheme, the volume of fuel raised to injection pressure during the course of an hour of typical vehicle use, is much greater than the volume of fuel actually injected during that same hour of use. Although pre-metering and various spill control techniques can be used to some advantage in this regard, none of these techniques satisfactorily regulates the power output of the high pressure pump itself.

Another difficulty is encountered with high pressure pumps that are driven directly by the engine (e.g., crank shaft cam shaft, accessory belt). During transients when fuel demand is low (e.g., downhill or during gear shifting), the engine continues to turn and the pump continues to deliver high pressure fuel to a common rail that may already be at maximum pressure.

According, it is an object of the present invention to provide a high pressure gasoline common rail direct injection fuel supply system, in which the high pressure discharge of the means for raising and maintaining the rail pressure above 100 bar, is responsive to engine demand. The energy imparted to the discharged fuel (e.g., pressure increase) is over time, significantly reduced relative to conventional systems.

SUMMARY OF THE INVENTION

According to the invention, a multifunction valve arrangement is provided in a common rail fuel supply system, which has a distributor portion to which the injectors are connected, and an accumulator portion that keeps the target pressure in the distributor portion. The invention provides a pressure based closed loop control to implement three modes of operation. A switching spool valve and a recirculation spool valve in direct fluid communication with the discharge of the high pressure pump provide self-regulation of the interplay between pumping of pressurized fuel against the high pressure in the accumulator in one mode and recirculation of fuel pumped at lower pressure to the feed source in another mode. In this manner, fuel is highly pressurized only intermittently, when needed to maintain a target accumulator pressure and/or differential pressure between the accumulator and the distributor portion. A third, discharge valve is provided in direct fluid communication with the accumulator, distribution rail, and the low pressure feed source, for implementing a third mode whereby the pressure in the distributor can be reduced by exposure to the low pressure of the feed source.

The preferred arrangement for implementing the invention comprises a distributor rail fluidly connected to at least one fuel injector, an accumulator chamber fluidly connected to the distributor rail, a high pressure fuel pump that has an inlet for receiving fuel from a low pressure feed system and an outlet chamber for providing fuel at high pressure to the accumulator. A recirculation valve is fluidly connected to the pump outlet chamber, the accumulator, and the low pressure feed system. At a first position the recirculation valve fluidly aligns the outlet chamber with the accumulator for delivery of high pressure fuel to the accumulator and in a second position aligns the outlet chamber with the low pressure system for recirculation of fuel through the high pressure pump substantially at the pressure in the low pressure system. A switching valve is fluidly connected to the pump outlet chamber, the accumulator, and the recirculation valve, wherein at a first position the switching valve actuates the recirculation valve to said first position and at a second position the switching valve actuates the recirculation valve to said second position. The switching valve includes means for establishing a set point pressure whereby when the pressure in the accumulator is below the set point, the switching valve actuates the recirculation valve to said first position and when the pressure in the accumulator reaches the set point, the switching valve actuates the recirculation valve to said second position.

The invention preferably includes a discharge valve fluidly connected to the accumulator, the low pressure system, and the distributor rail, wherein at a first position the discharge valve aligns the accumulator with the distribution rail for delivering fuel at the pressure in the accumulator to the distribution rail, and at a second position the discharge valve aligns the distributor rail with the low pressure system for relieving pressure in the distributor rail. The discharge valve in said second position, may fluidly isolate the distribution rail from the, whereby the accumulator pressure is not also relieved.

Those familiar with this field of technology will readily appreciate that the invention as described and claimed herein will achieve the foregoing object.

DETAILED DESCRIPTION

Figure 1:
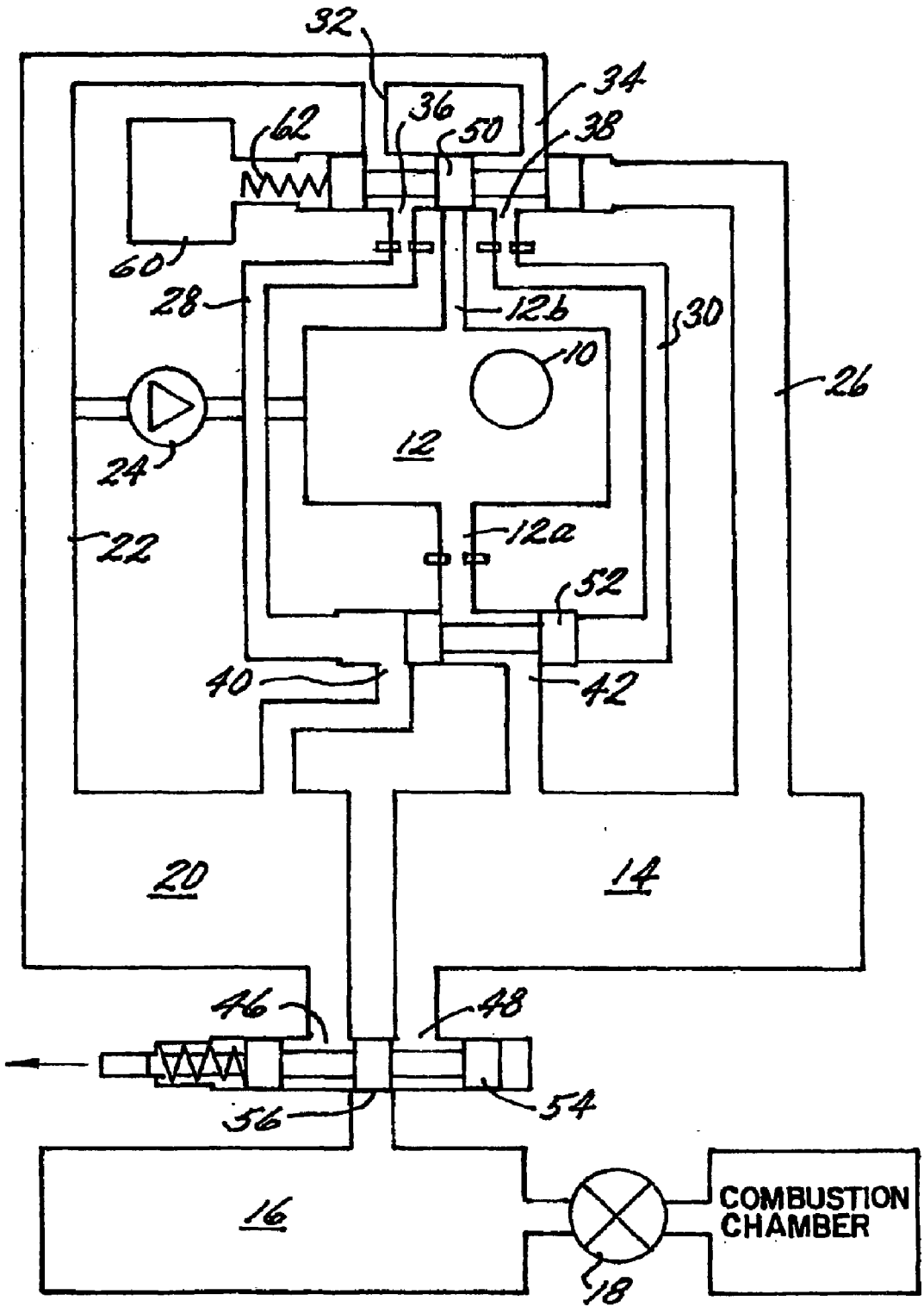
FIG. 1 is schematic representation of a first embodiment of the invention, whereby a switching spool valve responds to system pressure differentials so as to operate a recirculation spool valve whereby fuel is highly pressurized only intermittently, when needed to maintain a target accumulator pressure and/or differential pressure between the accumulator and the distributor.

According to the embodiment of the invention shown in FIG. 1, a high pressure pump 10 discharges to a high pressure pumping chamber 12 that has discharge passages 12*a* and 12*b*. The main high pressure fuel delivery path follows passage 12*a* into accumulator 14, where fuel is maintained above, e.g., 100 bar, at a differential pressure through ports 48 and 56 above the pressure in the distribution portion 16 of the rail. A plurality of injectors 18 are exposed to the fuel pressure of the distribution portion, for injecting fuel into the engine in pulses in response to injector commands from the electronic control system. A fuel tank 20 or other source at, e.g., atmospheric pressure, provides fuel through passage 22 to a low pressure feed pump 24, which feeds the high pressure pump 10.

To accomplish the multiple modes of operation, passages 28 and 30 are selectively fluidly connected with passage 12*a* through a recirculation spool valve and associated chamber 52, and with the switching spool valve and associated chamber 50 (via ports 36 and 38). Passage 12*b* is likewise selectively in fluid communication with the chamber of switching spool valve 50. The passage 22 is in selective fluid communication with the spool valve chamber 50 via split passages 32 and 34. Passage 26 fluidly connects the accumulator 14 to the switching valve chamber 50. The passages 28 and 30 are provided for effectuating movement of valves 50 and 52, based on pressure feedback through at least passage 26. Ports 40 and 42 fluidly connect valve chamber 52 to atmospheric pressure (the fuel tank 20) and the high pressure accumulator 14, respectively, and ports 46, 48, and 56 can be selectively fluidly connected according to the movement of actuated discharge valve in associated chamber 54.

Figure 2:
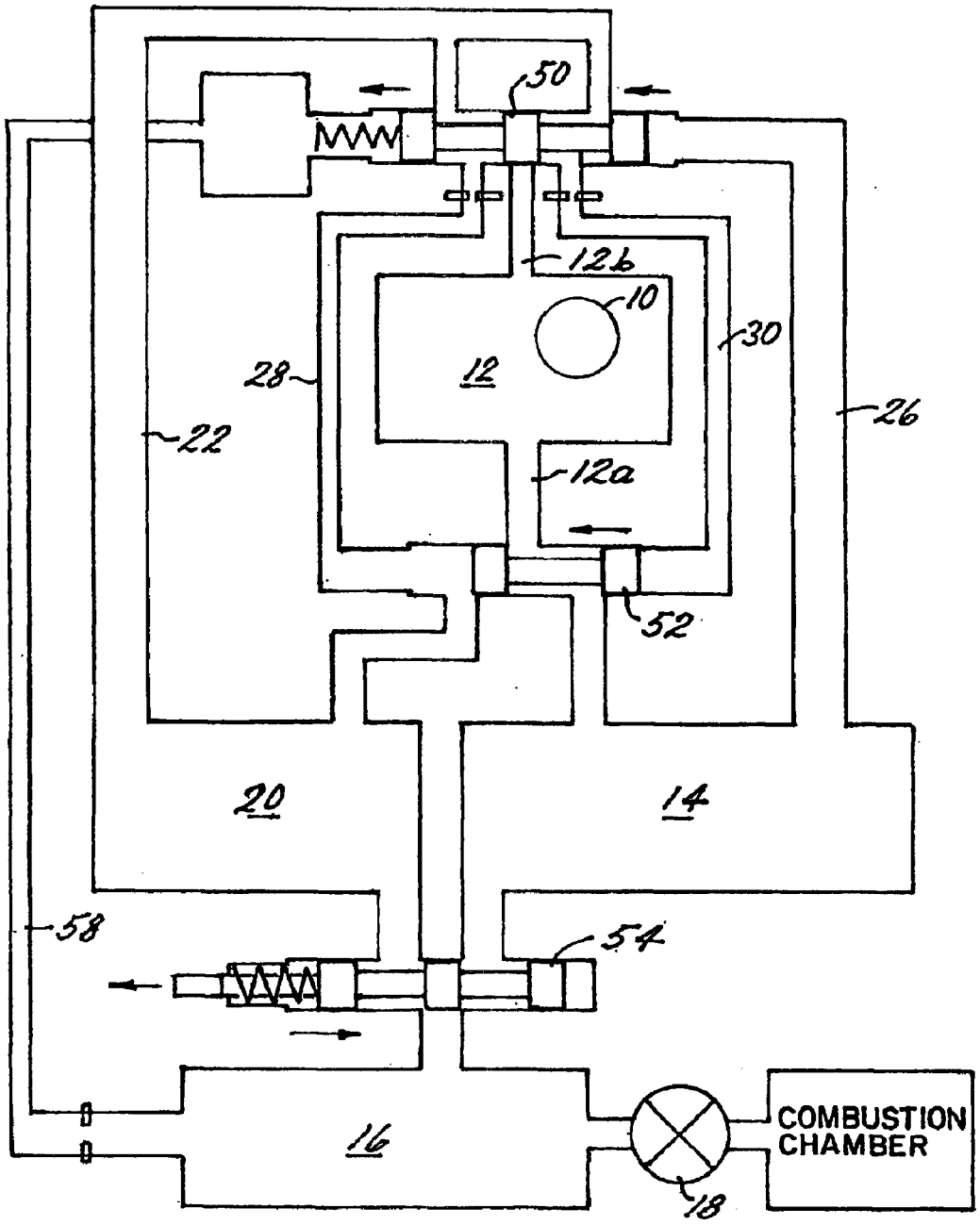
FIG. 2 is a schematized representation of a second embodiment wherein the distributor rail pressure provides a bias to the switching spool valve.

In the preferred embodiment, as shown in FIG. 2, the distributor rail portion 16 is fluidly connected via passage 58 to the chamber 60, which provides the bias for switching valve 50. Further description will be made with reference to FIG. 2.

The accumulator filing mode of operation occurs continuously during cranking, wherein the engine is turning at only about 100 RPM and maximum fuel delivery to the distribution portion 16 is desired, but intermittently during cruising. For filling, switching valve 50 moves to the right, closing feedback passage 26, and opening port 38 so valve 52 can move to the right, thereby opening port 42. Valve 54 is in its normal (non-actuated) position, opening ports 48 and 56, while closing port 46. The pressure in distributor rail portion 16 is fed back to the switching chamber via passage 58, while the accumulator pressure is fed back to the switching chamber via passage 26. Flow is vented from the switching chamber 50 to the fuel tank (or equivalently, the inlet chamber to the feed pump or other low pressure point) via passages 34 and 22. This continues until the switching spool valve 50 closes off the venting port to passage 34 as feedback pressure from the accumulator increases, moving the valve 50 to the left.

Figure 3:
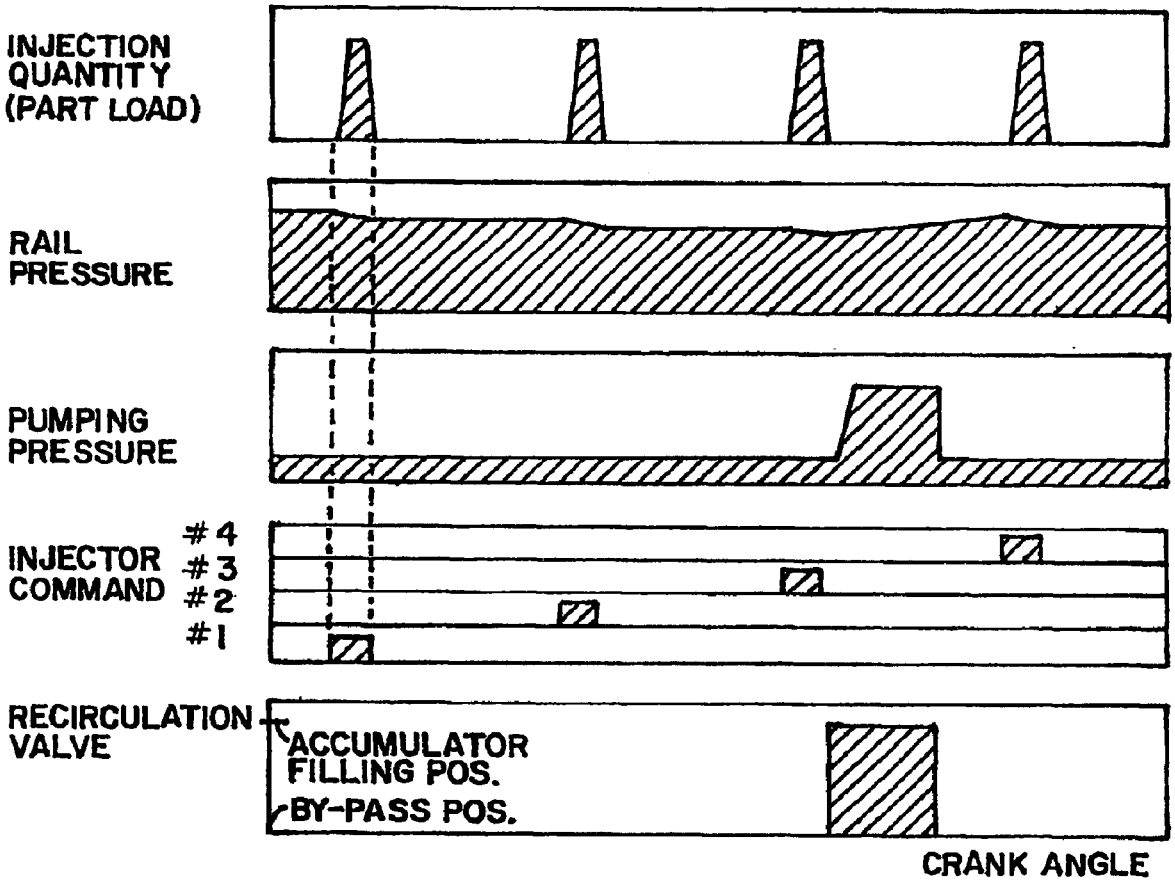
FIG. 3 is a graphic display of a prototypical relationship of the pulsed injection quantities, the rail pressure, the pumping pressure, the injector command signals, and the recirculation valve movement.

When the accumulator is at the target pressure (typically over 100 bar), the recirculation mode reduces the pressure output of the high pressure pump. The high pressure in passage 12*b* moves switching valve 50, which closes passage 34 and opens venting passage 32 and port 38. This high pressure is imposed on passage 30 and moves the recirculation valve 52 to close port 42 and open port 40. Venting of chamber 52 is accomplished via passages 28 and 32. Thereafter, so long as the accumulator pressure remains above a target threshold, the high pressure pump is not pumping against a high pressure in the accumulator, but rather against the low pressure of the source 20. As the pressure in the accumulator 14 drops, approaching that of the pressure in the distribution rail 16, the return spring 62 resets the switching valve 50 to the filling mode. The relationship of the pulsed injection quantities, the rail pressure, the pumping pressure, the injector command signals, and the recirculation valve movement are illustrated in FIG. 3. Clearly, the high pressure pump is relieved of high pressure pumping duty for the duration of a plurality, for example four to six or more, injection events. This reduces the power requirements of the pump as well as the heat generated.

In the third mode of operation, the rail pressure can be reduced quickly by external actuation of the discharge valve 54 (to the right). This in effect dumps some fuel at high pressure in the distribution rail 16 directly through ports 56 and 46 to the source pressure at 20, until a new desired rail pressure is achieved. Port 48 is closed, whereby the accumulator pressure is maintained during the dumping, thereby facilitating the restoration of the normal filling and recirculation modes. Valve 54 can be actuated, for example, to decrease rail pressure when the vehicle is stopped or when traveling downhill.

What is claimed is:

1. A common rail fuel injection system for a motor vehicle, comprising:

a distributor rail 16 fluidly connected to at least one fuel injector 18;

an accumulator chamber 14 fluidly connected to the distributor rail, for supplying high pressure fuel to the distributor rail;

a high pressure fuel pump 10 that has an inlet for receiving fuel from a low pressure feed system 20,22, 24 and an outlet chamber 12 for proving fuel at high pressure to the accumulator 14;

a recirculation valve 52 fluidly connected to the pump outlet chamber 12, the accumulator 14, and the low pressure feed system, wherein at a first position the recirculation valve fluidly aligns the outlet chamber 12 with the accumulator 14 for delivery of high pressure fuel to the accumulator and in a second position aligns the outlet chamber with the low pressure system for recirculation of fuel through the high pressure pump substantially at the pressure in the low pressure system; and a switching valve 50 fluidly connected to the pump outlet chamber 12, the accumulator 14, and said recirculation valve 52, wherein at a first position the switching valve 50 actuates said recirculation valve 52 to said first position and at a second position the switching valve 50 actuates said recirculation valve 52 to said second position;

said switching valve 50 including means 62 for establishing a set point pressure whereby when the pressure in the accumulator 14 is below the set point, the switching valve 50 actuates the recirculation valve 52 to said first position and when the pressure in the accumulator 14 reaches the set point, the switching valve 50 actuates the recirculation valve 52 to said second position.

2. The system of claim 1, further including a discharge valve 54 fluidly connected to the accumulator 14, the low pressure system 22, and the distributor rail 16, wherein at a first position the discharge valve aligns the accumulator with the distribution rail for delivering fuel at the pressure in the accumulator to said distribution rail and at a second position the discharge valve aligns the distributor rail with the low pressure system for relieving pressure in the distributor rail.

3. The system of claim 2, wherein the discharge valve 54 in said second position, fluidly isolates the distribution rail from the accumulator 14, whereby the accumulator pressure is not also relieved.

4. The system of claim 3, wherein the discharge valve includes electromechanical means for actuating the discharge valve to the second position and returning the discharge valve to the second position.

5. The system of claim 1, wherein the means 62 for establishing said set point comprises a fluid connection between the distribution rail 16 and said switching valve 50.

6. The system of claim 1, wherein the switching valve 50 and the recirculation valve 52, are spool valves.

7. The system of claim 6, wherein the switching spool valve 50 has opposed venting ports and passages fluidly connectable to the low pressure system.

8. The system of claim 7, wherein the recirculation valve 52 has opposed venting ports and passages that are fluidly connectable to the venting ports and passages of the switching valve 52.

* * * * *